US005784889A

United States Patent [19]

Joos et al.

[11] Patent Number: 5,784,889

[45] Date of Patent: Jul. 28, 1998

[54] DEVICE FOR DAMPING THERMOACOUSTIC PRESSURE VIBRATIONS

[75] Inventors: Franz Joos, Weilheim, Germany; Marcel Schirbach, Adlikon, Switzerland

[73] Assignee: Asea Brown Boveri AG, Baden, Switzerland

[21] Appl. No.: 720,865

[22] Filed: Oct. 3, 1996

[30] Foreign Application Priority Data

Nov. 17, 1995 [DE] Germany ..... 195 42 918.4

[51] Int. Cl.[6] ..... F02C 7/24

[52] U.S. Cl. ..... 60/725; 431/19; 431/114

[58] Field of Search ..... 60/725; 381/71.5, 381/71.7, 191; 431/2, 19, 114; 181/206

[56] References Cited

U.S. PATENT DOCUMENTS

| | | | |
|---|---|---|---|
| 4,111,636 | 9/1978 | Goldberg | 431/2 |
| 4,644,783 | 2/1987 | Roberts et al. | 431/114 |
| 5,428,951 | 7/1995 | Wilson et al. | 60/725 |
| 5,498,127 | 3/1996 | Kraft et al. | 60/725 |

FOREIGN PATENT DOCUMENTS

| | | |
|---|---|---|
| 2063363 | 7/1971 | Germany . |
| 4228948A1 | 3/1994 | Germany . |
| 4241729A1 | 6/1994 | Germany . |
| 4339094A1 | 5/1995 | Germany . |
| 6-193470 | 7/1994 | Japan . |
| 2 161 916 | 1/1986 | United Kingdom . |

*Primary Examiner*—Charles G. Freay

*Attorney, Agent, or Firm*—Burns, Doane, Swecker & Mathis, L.L.P.

[57] ABSTRACT

A device for damping thermoacoustic pressure vibrations in a combustion chamber (1), in particular in the combustion chamber of a gas turbine, includes a pressure sensor (6) which is connected to the input of a regulating device (10), the regulating device (10) is connected at its output to a device for electrically controlling the flame in the combustion chamber (1). This device for electrically controlling the flame includes a voltage source (11) and an electrode (14). The electrode (14) is connected to a heat shield (12) which surrounds the outflow side of a burner (3) in an annular manner.

2 Claims, 1 Drawing Sheet

DEVICE FOR DAMPING THERMOACOUSTIC PRESSURE VIBRATIONS

BACKGROUND OF THE INVENTION

1. Field of the Invention

The invention relates to a device for damping thermoacoustic pressure vibrations.

2. Discussion of Background

During the combustion of fuels in a combustion chamber, pressure fluctuations may occur on account of the combustion processes, which pressure fluctuations excite thermoacoustic vibrations under suitable conditions. These vibrations encourage the increase of pollutant emissions on account of combustion inhomogeneities. At vibration resonance, the pressure vibrations constitute an undesirable material stress for the combustion chamber and impair the flame to the point of extinction. In order to dampen such thermoacoustic vibrations, various devices and methods have already been proposed in which the combustion chamber is influenced in its vibration properties for example. A periodic variation in the flow quantities of fuels has likewise been proposed for the reduction of vibrations. A feature common to these devices and the regulating methods implemented with them to reduce vibrations is that they detune the resonant frequency of a burner/combustion-chamber arrangement and thus dampen thermoacoustic vibrations. Thus devices are proposed here which bring about an indirect reduction of the pressure vibrations with a comparatively slow regulating compensation behavior.

SUMMARY OF THE INVENTION

Accordingly, one object of the invention is to reduce and/or dampen thermoacoustic pressure vibrations by means of direct control of the flame, which thermoacoustic pressure vibrations develop during the combustion of inflowing fuel in a combustion chamber.

The essence of the invention therefore consists in designing the device in such a way that, upon a change in the vibration to be damped, the flame is correspondingly influenced electrically via a regulating circuit having a connected voltage source.

The essential advantage of the invention may be seen in the fact that the vibration-damping measures proposed here act directly on the flame front, and thus comparatively quick compensation of the regulating circuit is effected.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
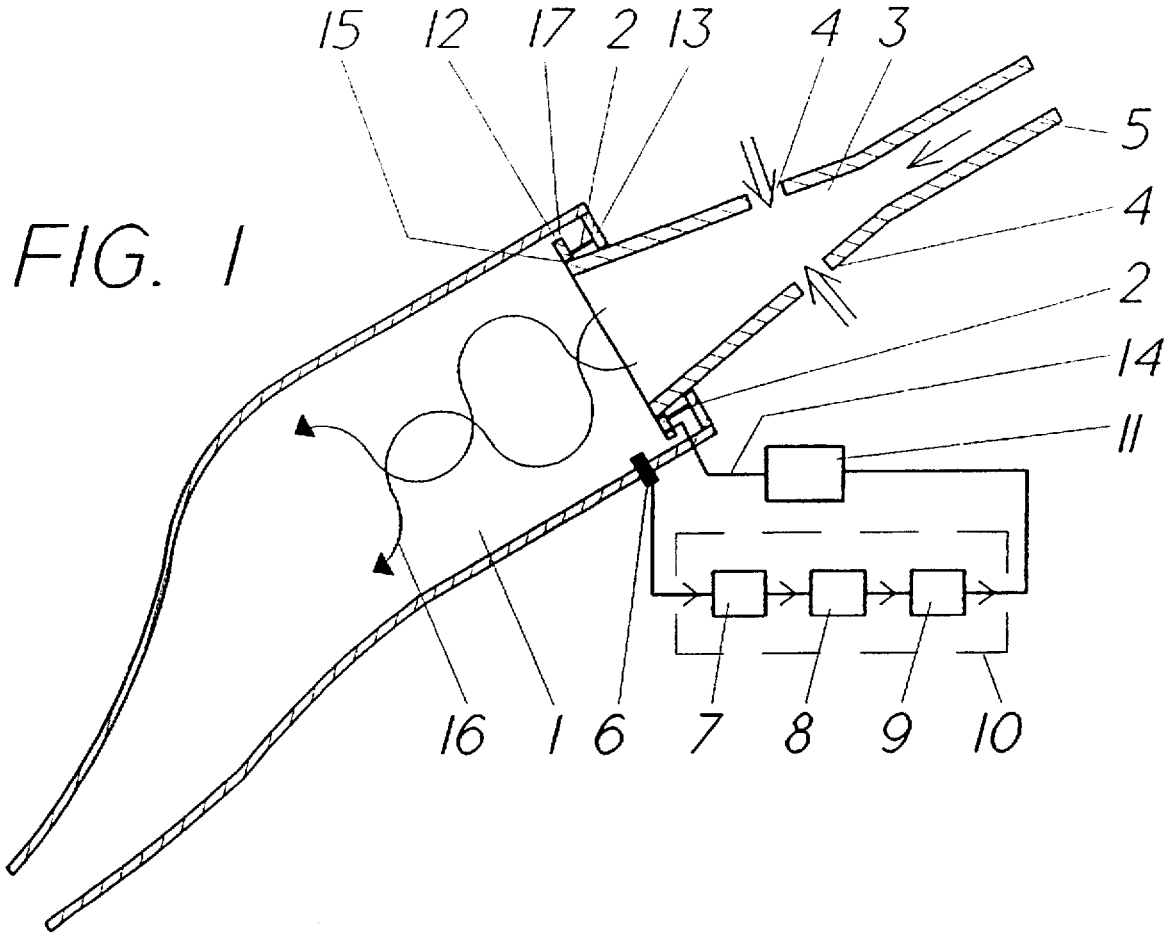
FIG. 1 shows a partial longitudinal section of a burner system with a regulating circuit.

Referring now to the drawings, wherein like reference numerals designate identical or corresponding parts throughout the several views, only the elements essential for understanding the invention are shown, and the direction of flow of the fuel and the supplied combustion air and the effective direction of the regulating circuit are shown by arrows. FIG. 1 shows in cross-section a combustion chamber 1 into a which a burner 3 projects. The outflow side of the burner 3 is provided by the opening of a combustion-chamber front plate 13 and by an opening 15 in a heat shield 12 without the burner 3 coming into contact with the heat shield 12. The heat shield 12 is made of a heat-resistant, electrically conductive metal alloy and is screwed to the combustion-chamber front plate 13 by a number of insulating screw connections 2 in both an electrically and thermally insulated manner. The burner 3 is supplied with fuel via a fuel line 5 and with combustion air via air inlets 4. The thermoacoustic pressure vibrations occurring due to inhomogeneous combustion of a flame 16 are detected by a pressure sensor 6 installed in the combustion chamber 1. The pressure sensor 6 is connected via a regulating device 10 to a voltage source 11 and an electrode 14, and the electrode 14 is electrically connected to the heat shield 12 installed in an insulated manner.

The series connection comprises the regulating device 10, a signal conditioner 7 which is connected on the input side to the pressure sensor 6, a signal processor 8 and an activating means 9 which is connected on the output side to the voltage source 11.

Figure 2:
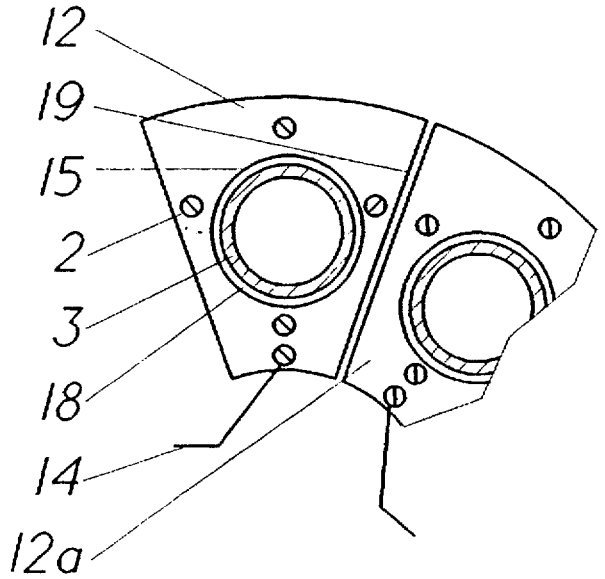
FIG. 2 shows a plan view of a heat shield.

FIG. 2 shows a plan view of the heat shield 12 in the opposite direction to the fuel flow. Here, the heat shield 12 is designed as a ring segment of an annular gas-turbine combustion chamber and has a circular opening 15. The insulating screw connections 2 are arranged around the opening 15, and the heat shield 12 is electrically connected to the electrode 14. There is an electrically and thermally insulating, annular air gap 18 between the burner 3 and the opening 15 of the heat shield 12. Furthermore, the heat shield 12 is insulated from adjacent heat shields **12*a* by means of air gap 19 and, as shown in FIG. 1, is likewise insulated from the walls of the combustion chamber 1 by an air gap 17**.

On account of its electrically and thermally insulated arrangement, the heat shield 12 can be loaded as electric field electrode by an electric potential generated by the voltage source 11. The aim of using the electric potential is to control the combustion properties of the flame 16 in a regulated manner.

At this point, it is stressed by way of explanation that the flame 16 is considered below as a highly ionized, electrically conductive plasma and can therefore be controlled in its combustion properties by loading with an electric potential. Only a few thousand volts of an electrode arranged near the flame are sufficient, for example, to control the combustion. The comparatively small energy loss of the loading voltage source occurring as a result is about 0.01% of the controlled combustion energy. The electric field causes electric forces to act on the ions contained in the flame. In this way, a type of electric wind develops within the flame 16, which electric wind has a striking effect on the combustion velocity of the flame 16 and stabilizes it. While utilizing this phenomenon by means of the device according to the invention, the combustion in the flame 16 is regulated in such a way that the load-dependent, thermoacoustic pressure vibrations caused by it are reduced and/or damped. It is especially advantageous here that no masses have to be moved for the action on the flame 16 and that the regulating compensation is effected comparatively quickly by the direct electrical control of the flame.

The most suitable regulated variable for the regulating device 10 is the pressure in the combustion chamber 1, which pressure is detected by the pressure sensor 6. The measured pressure values are transmitted to the signal conditioner 7 and subsequently further processed in the signal processor 8. The contiguously installed control unit 9 generates corresponding signals for the voltage source 11. In accordance with the load-dependent pressure vibrations, the voltage source 11 then loads the heat shield 12 via the electrode 14 with a positive direct-current voltage in the range up to a few thousand volts.

Since the outlet of the burner 3 and thus the flame front of the flame 16 are surrounded by the opening 15 of the heat shield 12, this heat shield 12 acts on the flame 16 like a positively charged annular electrode, and the flame 16 is controlled by the regulating method described above, it being especially advantageous that no moving mass is required for the regulating device.

Of course, the invention is not restricted to the exemplary embodiment shown and described. It is also conceivable within the scope of the invention to load the heat shield 12 with a negative or alternating voltage. The arrangement of a different geometric shape of electrode in the region of the flame 16 is also conceivable according to the invention. A rod electrode, for example, could also be used here. Parallel voltage loading of all the heat shields 12 of a combustion chamber 1 which are arranged in a ring is likewise conceivable within the scope of the invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. The device for damping thermoacoustic pressure vibrations in a combustion chamber comprising a regulating device including an input and an output, a pressure sensor connected to said input of said regulating device, wherein said regulating device is connected at said output to means for electrically controlling the flame in the combustion chamber, wherein said means for electrically controlling the flame comprises a voltage source and an electrode, and wherein said electrode is connected to a heat shield which annularly surrounds the outflow side of a burner.

2. The device according to claim 1, wherein said combustion chamber comprises the combustion chamber of a gas turbine.

* * * * *